US005642678A

United States Patent [19]

Mizunuma et al.

[11] Patent Number: 5,642,678

[45] Date of Patent: Jul. 1, 1997

[54] THREAD GUIDE DEVICES OF A SEWING MACHINE

[75] Inventors: Masanori Mizunuma; Shinji Kojima, both of Utsunomiya, Japan

[73] Assignee: The Singer Company N.V., Curaco, Netherlands Antilles

[21] Appl. No.: 663,483

[22] Filed: Jun. 13, 1996

[30] Foreign Application Priority Data

Jun. 14, 1995 [JP] Japan ..... 7-170497

[51] Int. Cl.[6] ..... B65H 57/08; D05B 47/00

[52] U.S. Cl. ..... 112/302

[58] Field of Search ..... 112/302, 254, 112/225, 162, 163, 165, 259, 166

[56] References Cited

U.S. PATENT DOCUMENTS 3,359,932 12/1967 Eguchi et al. ..... 112/302
3,552,678 1/1971 Du Ross ..... 112/302 X
4,784,072 11/1988 Kessler ..... 112/302
5,042,407 8/1991 Jimenez ..... 112/254

*Primary Examiner*—Ismael Izaguirre
*Attorney, Agent, or Firm*—McCormick, Paulding & Huber

[57] ABSTRACT

Thread guide devices capable of easily and quickly performing a threading operation with an excellent operability, whereby a thread is hardly come off or entangled, and hence a sewing operation is hardly interrupted when the thread is come off or entangled, leading to an excellent sewing operating performance. Each thread guide device of sewing machine includes a thread guide member disposed between a thread spool and a tension device respectively provided on a body for guiding a thread from the thread spool, and the thread guide member comprises a base end portion attached to one end of a thread guide groove portion which is opened at an upper end of the body, a tip end portion having an inclination portion which is elastically brought into contact with a rear side wall of the body at a front surface of the inclination portion, and a thread accommodation space which is defined in a lower end portion of the thread guide groove portion.

3 Claims, 4 Drawing Sheets

THREAD GUIDE DEVICES OF A SEWING MACHINE

BACKGROUND OF THE INVENTION

1. Field of the invention

The present invention relates to thread guide devices of a sewing machine.

2. Prior Art

Conventional thread guide devices are shown in FIGS. 10 and 11. In this sewing machine, threads 52*a* such as looper threads, needle threads are threaded in the following manner, namely, firs fly setting thread spools 52 on spool pins respectively provided upright on a spool holder stand 50, hanging the threads 52*a* extended from the thread spools 52 on thread guides 53*a* of thread guide holder 53, threading the threads 52*a* into thread guide holes 55*a* of thread guide plate 55, inserting the threads 52*a* which are passed through the thread guide holes 55*a* into silt-shaped thread guide grooves 55*b* so as to be retained by recesses 55*c*, inserting the threads 52*a* into guide grooves 54*a* of a body 54, clamping the threads 52*a* between tension discs of tension devices provided at the front portion of the body 54, and threading the threads 52*a* into loopers, needles, etc., while the threads 52*a* are pulled downward.

However, the following are problems in the conventional thread guide devices.

(1) Since each thread 52*a* is sequentially threaded in each thread guide hole 55*a* of thread guide plate 55 and each thread guide groove 55*b*, and it is retained by each recess 55*c*, the threading operation is difficult and takes time.

(2) Since the thread 52*a* is guided while it is retained by the recess 85*c*, it is liable to come off not only when the thread guide 53*a* of the thread guide holder 53 is raised or lowered but also when the thread 52*a* is moved irregularly. As a result, a given tension necessary for the sewing operation can not be applied to the thread 52*a*.

(3) Since the upper portion of the thread guide plate 55 must protrude from the body 54 because of the threading of the thread 52*a* into the thread guide hole 55*a*, the thread 52*a* extended from the thread guide 53*a* is easily entangled with the thread guide plate 55 not only when the thread guide 53*a* of the thread guide holder 53 is raised or lowered but also when the thread 52*a* is moved irregularly.

SUMMARY OF THE INVENTION

The present invention has been made in view of the technical problems of the conventional thread guide device and has the following structure.

Thread guide devices of a sewing machine according to a first aspect of the invention comprises thread guide member 7 each disposed between each thread spool 6 and a tension device 8 respectively of a body 1 for guiding each thread 6*a* from each thread spool 6, wherein each of said thread guide devices 7 is characterized in comprising a base end portion attached to one end of each thread guide groove portion 1*b* which is opened at an upper end of the body 1, a tip end portion having an inclination portion 7*a* which is elastically brought into contact with a rear wall of the body 1 at a front surface of the inclination portion 7*a*, and a thread accommodation space 10 defined in a lower end portion of the thread guide groove portion 1*b*.

Thread guide devices of a sewing machine according to a second aspect of the invention is characterized in further including recesses 5*b* and 5*c* formed at a rear surface of the body 1 and positioned at right and left sides of a rear end portion of each thread guide groove portion 1*b*, wherein the base end portion of the thread guide member 7 is accommodated in one recess 5*b* and the tip end portion of the thread guide member 7 is accommodated in another recess 5*c*, and a chamfered portion 5*f* is formed at a cornered portion between the thread guide groove portion 1*b* and another recess 5*c*.

Thread guide devices of a sewing machine according to a third aspect of the invention is characterized in that the base end portion of each thread guide member 7 forms an attachment curved portion 7*b*, said attachment curved portion 7*b* is inserted into and elastically brought into contact with a retaining portion 6*e* formed at a lower surface of one recess 5*c* of the body 1.

As evident from the above arrangement, although the components of the thread guide devices are plural, they are explained as a single one for the convenience of explanation thereof.

The threading operation according to the first aspect of the invention will be carried out in the following manner, namely, pulling the thread 6*a* extended from the thread spool 6 provided on the body 1, e.g., by hanging the thread 6*a* on the thread guides 9*a* of a thread guide holder 3, then inserting a proper length of the end of the pulled thread 6*a* into the thread guide groove portion 1*b* of the body 1 from the upper portion thereof, pressing the thread 6*a* downward while a slight tension is applied to the thread 6*a*, whereby the thread 6*a* which Is lowered inside the thread guide groove portion 1*b* is brought into contact with the inclination portion 7*a* of the thread guide member 7 and is lowered along the inclination portion 7*a*. As a result, the thread 6*a* is entered between the tip end portion of the inclination portion 7*a* and the body 1 while it. elastically deforms the inclination portion 7*a* of the thread guide member 7, then it is passed through the tip end lower edge of the inclination portion 7*a*, and is received in the thread accommodation space 10. At this time, the front surface of the inclination portion 7*a* which is elastically brought into contact with the rear wall of the body 1 is pushed away. The inclination portion 7*a* is elastically restored to its original state after the thread 6*a* is passed therethrough, and then it is elastically brought into contact with the rear wall of the body 1. Accordingly, the thread 6*a* can be easily and quickly threaded by merely pressing the thread 6*a* along the thread guide groove portion 1*b*. Upon completion of the threading of the thread 6*a* into the thread guide member 7, the thread 6*a* is inserted between the pair of tension discs of the tension device 8 so that a given tension is applied to the thread 6*a*, then the tip end of the thread 6*a* is threaded into the needle, the looper, etc., to complete the threading operation.

According to the thread guide device of the first aspect of the invention, the tip end portion of the thread guide member 7 is restored to its original state after the thread 6*a* is threaded into the thread guide member 7, thereby defining the thread accommodation space 10 in the lower end portion of the thread guide groove portion 1*b* so as to remove a gap between the thread guide member 7 and the body 1. Accordingly, if the thread 6*a* is vertically moved between the thread spool 6 and the thread guide member 7, or even if the thread 6*a* is moved irregularly during the sewing operation, etc., the thread 6*a* will hardly come off the thread guide member 7, Since the thread guide member 7 is fixed to the rear surface of the body 1 and it can be attached to the body 1 not to protrude over the body 1, the thread 6*a* is hardly entangled with the thread guide member 7, etc., even if, for example, the thread guides of the thread guide holder 3 are moved up and down and even if the thread 6*a* is moved irregularly. Further, since the thread guide member 7 is exposed to the rear surface of the body 1, the thread guide member 7 can be easily replaced by another one even if it is deformed or deteriorated.

According to the second aspect of the invention, when the thread 6*a*, which is lowered in the thread guide groove portion 1*b*, is brought into contact with the inclination portion 7*a* of the thread guide member 7 and is lowered along the inclination portion 7*a*, the thread 6*a* is lowered while it is guided along the chamfered portion 5*f*, and is entered between the tip end portion of the inclination portion 7*a* and the side wall of the other recess 5*c* while elastically deforming the inclination portion 7*a*, and is passed through the tip end lower edge of the inclination portion 7*a* and then it is received in the thread accommodation space 10. Whereupon, the thread 6*a* is easily passed through the inclination portion 7*a* so that it is prevented from being damaged by the cornered portion between the thread guide groove portion 1*b* and the other recess 5*c*.

With such an arrangement of the thread guide device, the thread guide member 7 is elastically restored after the thread 6*a* is passed through the tip end lower edge of the inclination portion 7*a* so as to remove the gap between the thread guide member 7 and the side wall of the other recess 5*c*. Further, since the thread guide member 7 is received in the recess 5*b* and recess 5*c* not to protrude outward, the thread 6*a* is hardly entangled with the thread guide member 7, etc.

According to the third aspect of the invention, the attachment curved portion 7*b* that is a fixed part of the thread guide member 7 is attached to the retaining portion 5*e* by merely pushing the attachment curved portion 7*b* in the retaining portion 5*e*, and hence it is not liable to come off the retaining portion 5*e* even if the fixing means such as an adhesive, etc., is not used. Further, since the thread guide member 7 is exposed to the rear surface of the body 1, the thread guide member 7 can be easily replaced with another one when the thread guide member 7 is deformed or deteriorated.

PREFERRED EMBODIMENT OF THE INVENTION

Figure 1:
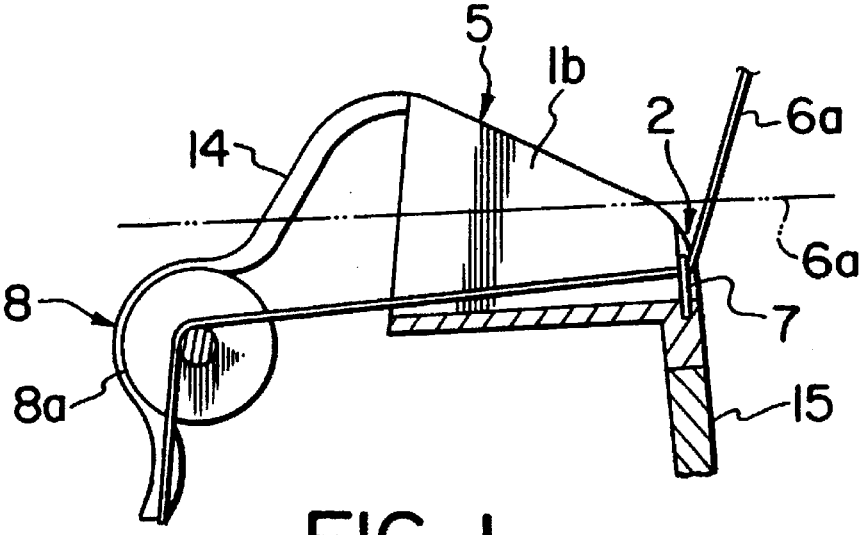
FIG. 1 is a cross sectional side view showing a main portion of a thread guide device of a sewing machine according to a preferred embodiment of the present invention.
Figure 2:
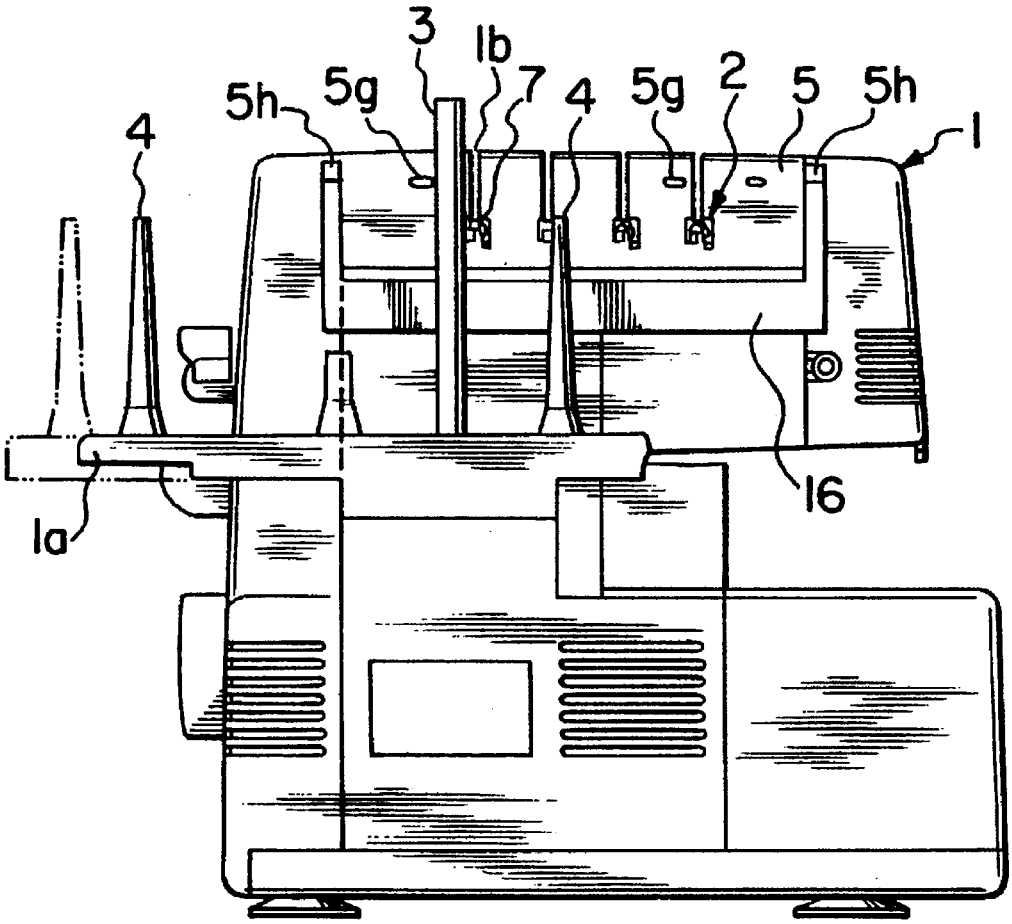
FIG. 2 is a rear view of the thread guide device of the sewing machine in FIG. 1 and the sewing machine.

A thread guide device 2 of a sewing machine according to a preferred embodiment of the invention will be now described with reference to FIGS. 1 through 9, which show an embodiment applied to a thread guide device of an overedge sewing machine. A body of a sewing machine 1 includes a spool stand 1*a* provided on a rear upper surface thereof, a thread guide holder 3 and a plurality of spool pins 4 respectively provided upright on the spool stand 1*a*. The thread guide holder 8 is telescopically movable and has a thread guide plate 9 attached to the upper end thereof as shown in FIG. 8. The thread guide plate 9 is formed by bending a wire rod and has a plurality of U-shaped thread guides 9*a* formed at the right and left thereof in a given interval. Actually, each thread guide 9*a* is formed to hang downward to have a U shape, and base ends (upper end in FIG. 8) of the U-shaped portions of each thread guide 9*a* are laid on the other so as to prevent the thread 6*a* from coming off, Each spool pin 4 sets a wound thread 6, i.e., thread spool while the latter is inserted into the former, and it is arranged at a position corresponding substantially to the lower portion of each thread guide 9*a*.

Figure 3:
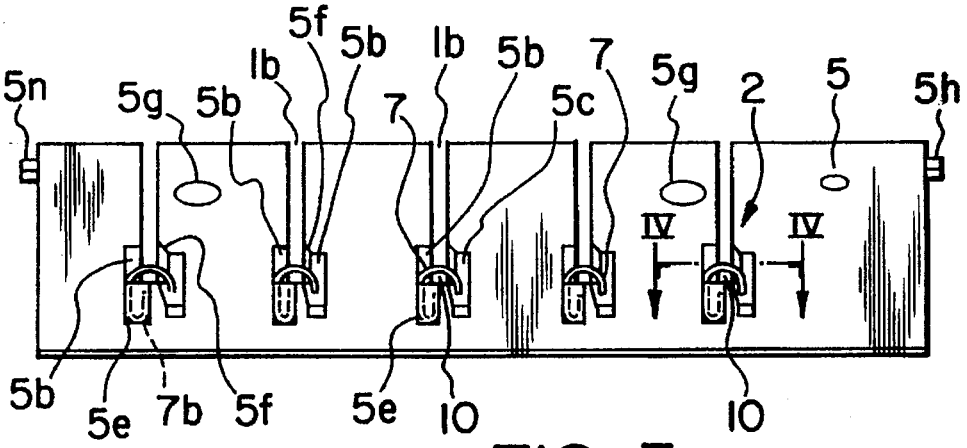
FIG. 3 is a rear view of an upper cover of the sewing machine in FIG. 2.
Figure 4:
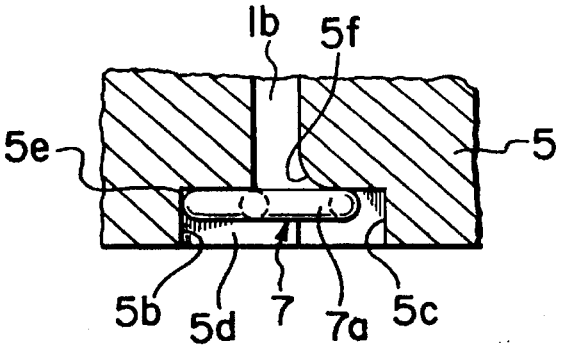
FIG. 4 is a cross sectional view taken along line IV—IV in FIG. 3.

The upper portion of the body 1 is formed by an upper cover 5 which is arranged between a pulley cover 12 and a right cover 13 respectively disposed at the left and right of the upper cover 5. Front and rear covers 14 and 15 are respectively disposed at the front and rear of the upper cover 5. A handle 16, which is swingably supported by the pulley cover 12 and the right cover 18, is held by hand when the sewing machine is moved. The thread guide device 2 is formed on the upper cover 5 in front of the thread guide holder 3. The upper cover 5 has a plurality of (four or five pieces in this embodiment) slip-shaped thread guide groove portions 1*b* which extend back and forth and are opened at the upper end and reach the intermediate portions thereof. Recesses 5*b* and 5*c* are formed at the rear surface of the lower end portion of each thread guide groove portion 1*b* and positioned at the right and left sides of the lower end portion as shown in FIG. 3. One recess 5*b* (left side when viewed from the rear portion) is formed to extend to a position corresponding to substantially the lower end of the thread guide groove portion 1*b* and the other recess 5*c* (right side when viewed from the rear portion) is formed to extend vertically at a position corresponding to the lower end of the thread guide groove portion 1*b* serving as a center thereof. Whereupon, the lower surface of one recess 5*b* forms a step surface 5*d*. A retaining portion 5*e*, that is a hole extending downward, is formed on the step surface 5*d*. A chamfered portion 5*f* extending up and down is formed at a cornered portion between the other recess 5*c* and the thread guide groove portion 1*b* as shown in FIGS. 3 and 4.

Figure 5:
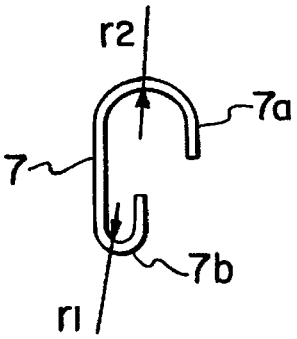
FIG. 5 is a view showing a thread guide member of the thread guide device in FIG. 1.
Figure 6:
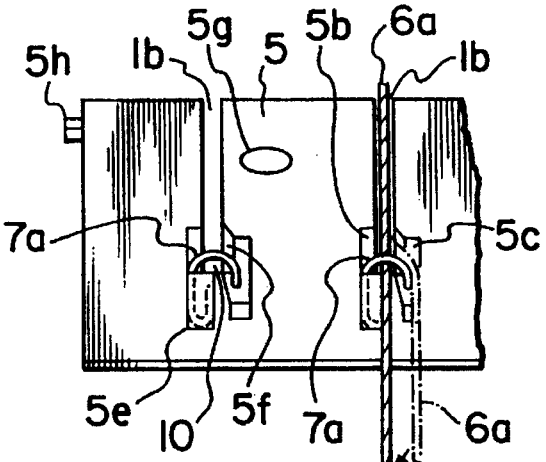
FIG. 6 is a view showing a threading operation.

Each thread guide member 7 is attached to the retaining portion 5*e*. Each thread guide member 7 is formed by bending a spring wire rod so as to form a ring shape a part of which is chipped off as shown in FIG. 5. Each thread guide member 7 comprises an inclination portion 7*a* at the upper end portion having a large diameter (radius of $r_2$) curved portion which is convex upward, and a small diameter (radius of $r_1$) attachment curved portion 7*b* at the lower end portion which is concave downward. The attachment curved portion 7*b* is inserted into the retaining portion 5*e* while it is elastically deformed and is elastically brought into contact with an inner wall of the retaining portion 5*e*. The base end portion of the thread guide member 7 is accommodated in one recess 5*b* in a state where the thread guide member 7 is attached to the upper cover 5 as shown in FIGS. 3 and 4. At this time the large diameter inclination portion 7*a* traverses the lower end upper portion of the thread guide groove portion 1*b* at the rear surface side thereof and the tip end portion of the thread guide member 7 is received in the other recess 5c, while the tip end front surface of the thread guide member 7 is elastically brought into contact with the front wall of the other recess 5c (rear wall of the body 1), and the tip end lower edge of the inclination portion 7a is positioned slightly under the lower end of the thread guide groove portion 1b. Whereupon, the inclination portion 7a having an upper half surface which is inclined at least at the other recess 5c has a semicircular thread accommodation space 10 and receives the thread 6a at the lower end portion of the thread guide groove portion 1b.

The upper cover 5 is fixed by screws and forms the upper portion of the body 1. That is, protrusions 5h provided at both sides of the upper cover 5 are respectively retained by the step surfaces of the pulley cover 12 and the right cover 13 (not shown) as shown in FIG. 3, and they are positioned while they are respectively supported by the rear surface of the front cover 14 and the upper surface of the rear cover 15 as shown in FIG. 1. Screws are screwed into through holes 5g defined in the upper cover 15 each comprising a long hole, and they are attached to the pulley cover 12, the right cover 13, etc. The thread guide groove portion 1b is formed while connecting to the upper cover 5 and the front cover 14 in a state where the upper cover 5 and the front cover 14 are attached to the body 1, and a pair of tension discs 8a of the tension device 8 are positioned in front of the upper cover 15 and the thread guide groove portions 1b of the front cover 14.

The operation of the thread guide device will be now described. The threading operation of the thread 6a such as a looper thread and a needle thread will be performed as follows.

The thread 6a is first set on the spool pin 4 provided upright on the spool stand 1a, then the thread 6a is hung between the thread guides 9a of the thread guide holder 3 and drawn by a given amount. Successively, the thread 6a is picked up by hands in a proper length and threaded into the thread guide device 2. That is, the thread 6a, which is picked up by the hands at the front and rear sides of the body 1, is inserted into the thread guide groove portion 1b of the body 1 as shown by an imaginary line in FIG. 1, and it is pulled down while a given tension is applied to the thread 6a. When the thread 6a is lowered while it is biased to the other recess 5c in the thread guide groove portion 1b, the thread 6a is brought into contact with the inclination portion 7a and is lowered along the curved upper surface of the inclination portion 7a as shown by broken lines in FIGS. 6 and 7.

Figure 7:
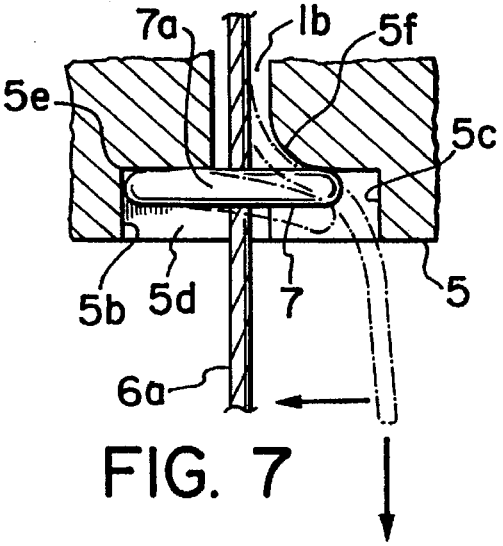
FIG. 7 is a view showing another threading operation.
Figure 8:
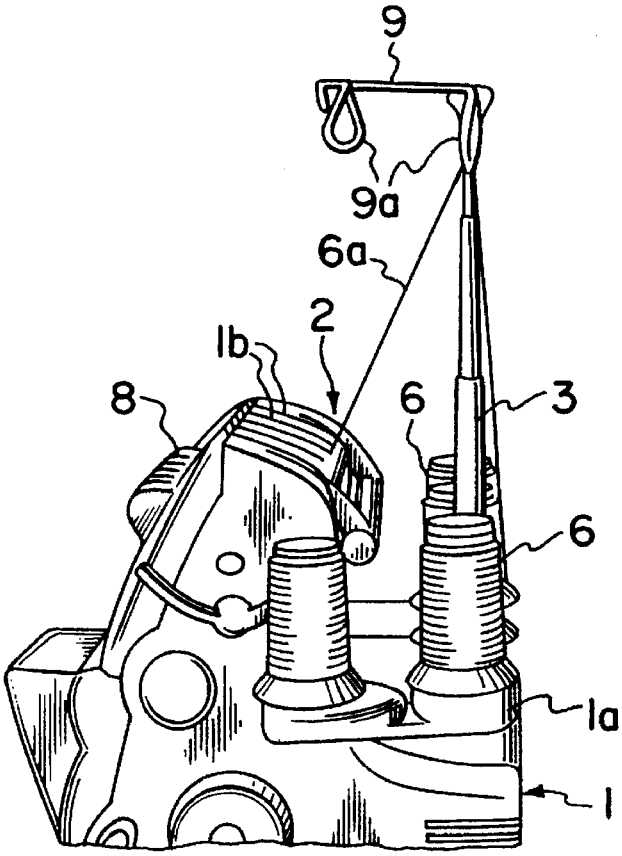
FIG. 8 is a perspective view showing a main portion of the sewing machine in FIG. 2.
Figure 9:
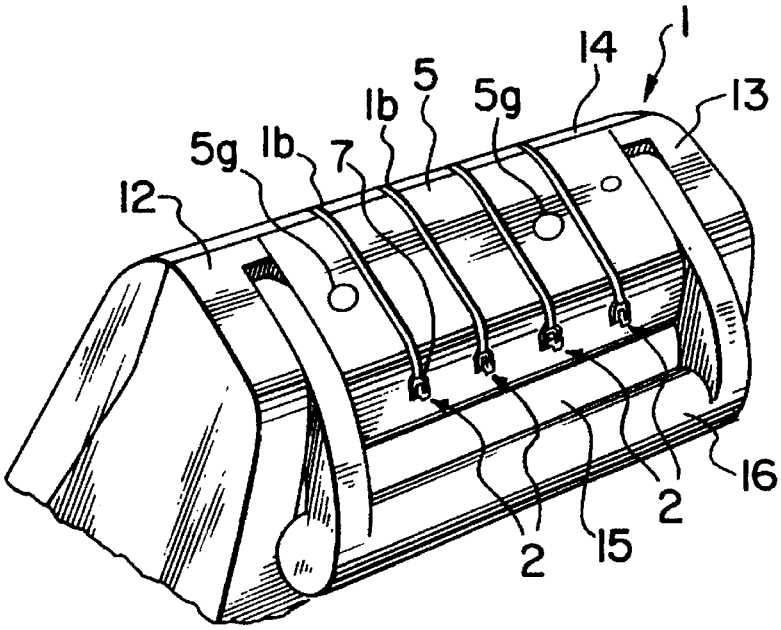
FIG. 9 is a perspective view showing a main portion of the sewing machine in FIG. 2.
Figure 10:
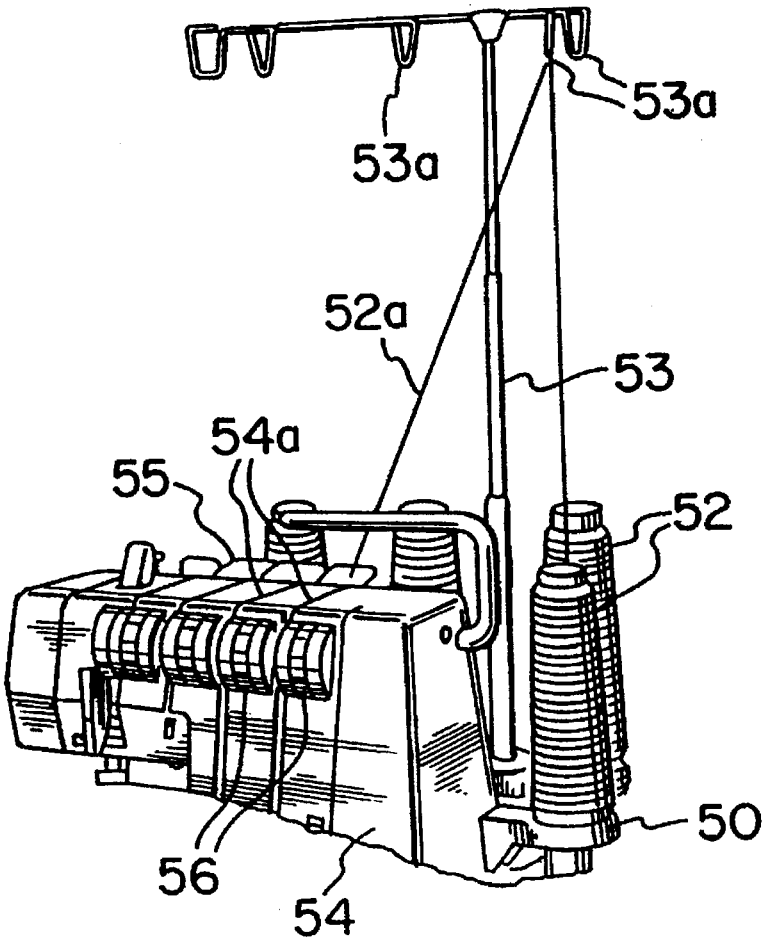
FIG. 10 PRIOR ART
FIG. 10 is a perspective view showing a main portion of a conventional sewing machine.
Figure 11:
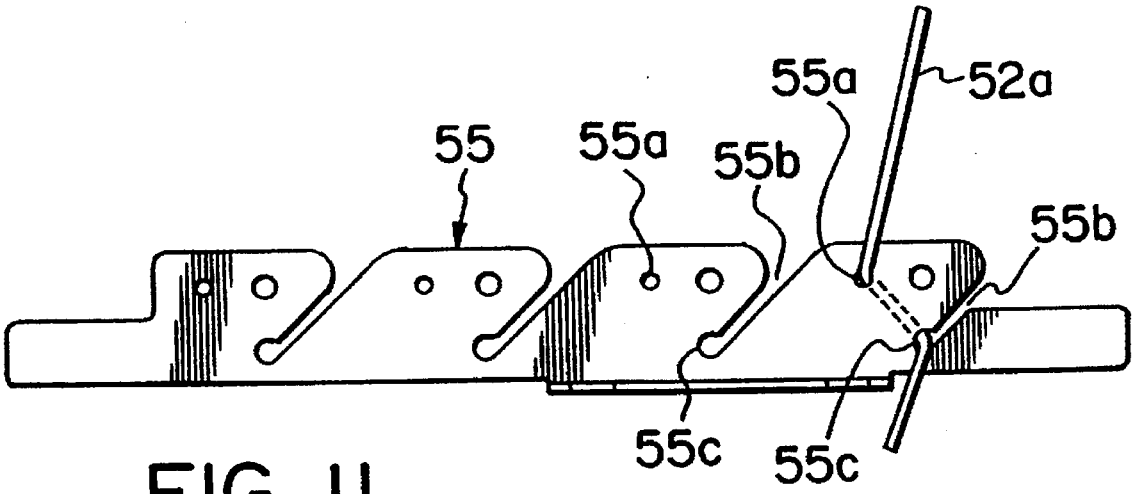
FIG. 11 PRIOR ART
FIG. 11 is a view showing a conventional thread guide plate.

As a result, the thread 6a is lowered while it is guided by the chamfered portion 5f, thereby elastically deforming the inclination portion 7a as shown by the broken lines in FIG. 7, then it is entered between the tip end of the inclination portion 7a and the side wall of the other recess 5c, and is passed through the tip lower edge of the inclination portion 7a and it is received inside the thread accommodation space 10. The rear end portion of the thread 6a is sufficiently lowered when the thread 6a is passed through the tip end lower edge of the inclination portion 7a. The lower end portion of the other recess 5c forms an inclination surface so as not to hinder the passage of the thread 6a through the tip end lower edge of the inclination portion 7a. The inclination portion 7a is elastically restored to the original state after the thread 6a is passed through the tip end lower edge of the inclination portion 7a, and it is elastically brought into contact with the side wall of the other recess 5c, thereby forming the thread accommodation space 10 between itself and the lower end of the thread guide groove portion 1b of the upper cover 5 while it is upwardly convex. As a result, the thread 6a is received in the thread accommodation space 10. Whereupon, the threading operation is easily and quickly performed by merely pressing the thread 6a along the thread guide groove portion 1b.

Upon completion of the threading of the thread 6a into the thread guide device 2, the thread 6a is threaded between the pair of tension discs 8a of the tension device 8, to apply a given tension to the thread 6a for removing the slack, hen the tip end of the thread 6a is threaded into a looper or a needle, whereby the threading operation will be completed.

According to the thread guide device 2, the tip portion of the thread guide member 7 is elastically restored to its original state after the thread 6a is threaded, thereby removing the gap between the thread guide member 7 and the side wall of the other recess 5c. As a result, even if the thread guides 9a of the thread guide holder 3 are raised or lowered or the thread 6a is moved irregularly, the thread 6a will hardly come off the thread guide member 7. Further, since the thread guide member 7 is attached to the rear surface of the upper cover 5 constituting the body 1 so that it does not protrude upward from the body 1, the thread 6a is hardly entangled with the thread guide member 7 and the upper cover 5 even if the thread guides 9a of the thread guide holder 3 are raised or lowered or the thread 6a is moved irregularly. Further, since the thread guide member 7 does not protrude outside while it is accommodated in the recesses 5b and 5c, the entanglement of the thread 6a with the thread guide member 7 is excellently prevented. Still further, the attachment curved portion 7b that is a fixed side of the thread guide member 7 can be fixed to the retaining portion 5e by merely pushing the attachment curved portion 7b inside the retaining portion 5e, and hence it does not come off the retaining portion 5e even if an adhesive is not used. Since the thread guide member 7 is exposed to the rear surface of the body 1, it is excellent in the attaching or detaching operation thereof, leading to the easy replacement thereof when it is deformed.

Since the other recess 5c is formed at a position which is further extended downward from the position corresponding to the lower end of the thread guide groove portion 1b, the thread 6a can get over the tip end lower edge of the inclination portion 7a when it is lowered while it is guided by the chamfered portion 5f. Additionally, the other recess 5c is formed by further extending downward from the position corresponding to the lower end of the thread guide groove portion 1b, and the tip end lower edge of the inclination portion 7a is positioned lower than the lower end of the thread guide groove portion 1b so that the thread 6a received in the thread accommodation space 10 will hardly come off the thread accommodation space 10.

Whereupon, although the thread guide member 7 has the inclination portion 7a at the upper end which is semicircular or inverted U-shape as shown in FIG. 5, and the attachment curved portion 7b at the lower end which is substantially U-shaped in the above embodiment, the inclination portion 7a may be formed in such a manner that the thread 6a, which is entered from the upper portion along the thread guide groove portion 1b, is directed toward and guided by the free end (tip end) thereof, and hence it may be formed by a linear inclined surface which is inclined downward toward the other recess 5c. The attachment curved portion 7b may have a V-shape or other shapes if it can be pressed on the retaining portion 5e and not turnable. The recesses 5b and 5c respectively formed at the rear surface of the thread guide groove portion 1b of the upper cover 5 at both sides thereof may be omitted, and the thread guide member 7 may be detachably attached to the rear surface of the upper cover 5, e.g., by screws. Even in such a case, it is preferable to form the chamfered portion 5*f* at the cornered portion between the thread guide groove portion 1*b* and the rear surface of the upper cover 5. Further, although the thread guide member 7 is provided on the upper cover 5, a plate-shaped thread guide plate is fixed to the upper cover 5, and the thread guide member 7 may be mounted on this thread guide plate.

What is claimed is:

1. Thread guide devices of a sewing machine including thread guide plates each disposed between each thread spool and a tension device respectively of a body for guiding each thread from each thread spool, said thread guide plates each comprising a base end portion attached to one end of each thread guide groove portion which is opened at an upper end of the body, a tip end portion having an inclination portion which is elastically brought into contact with a rear wall of the body at a front surface of the inclination portion, and a thread accommodation space defined in a lower end portion of the thread guide groove portion.

2. Thread guide devices according to claim 1, further including recesses formed at a rear surface of the body and positioned at right and left sides of a rear end portion of each thread guide groove portion, wherein the base end portion of the thread guide member is accommodated in one; recess and the tip end portion of the thread guide member is accommodated in another recess, and a chamfered portion is formed at a cornered portion between the thread guide groove portion and another recess.

3. Thread guide devices according to claim 2, wherein the base end portion of each thread guide member forms an attachment curved portion, said attachment curved portion is inserted into and elastically brought into contact with a retaining portion formed at a lower surface of one recess of the body.

* * * * *